United States Patent [19]

Marques

[11] 4,054,223

[45] Oct. 18, 1977

[54] PACKINGS FOR TRANSPORT AND STORAGE ESPECIALLY OF LIQUID AND PASTY PRODUCTS

[75] Inventor: Gilles Marques, Villenave D'Ornon, France

[73] Assignee: Liquitainer S.A., Lausanne, Switzerland

[21] Appl. No.: 712,917

[22] Filed: Aug. 9, 1976

[30] Foreign Application Priority Data

June 16, 1976 Switzerland ..... 7681/76

[51] Int. Cl.[2] ..... B65D 7/00; B65D 9/12; B65D 25/14

[52] U.S. Cl. ..... 220/4 F; 220/63 R; 220/23.83; 217/12 R; 217/43 A; 217/3 R

[58] Field of Search ..... 220/4 R, 4 F, 4 D, 1.5, 220/23.83, 63 R, 94 R, 95; 217/12 R, 13, 3 R, 43 R, 43 A, 125; 214/10.5 R, 10.5 S; 206/506, 203

[56] References Cited

U.S. PATENT DOCUMENTS

| | | | |
|---|---|---|---|
| 385,257 | 6/1888 | Ehle | 220/95 X |
| 2,826,332 | 3/1958 | Hudson | 206/203 X |
| 3,015,407 | 1/1962 | Fesmire et al. | 220/1.5 |
| 3,071,277 | 1/1963 | Olson et al. | 217/12 R |
| 3,635,361 | 1/1972 | Hayes | 214/10.5 R |
| 3,964,636 | 6/1976 | Rehrig | 220/63 R X |

*Primary Examiner*—William Price
*Assistant Examiner*—Steven M. Pollard
*Attorney, Agent, or Firm*—Young & Thompson

[57] ABSTRACT

The present invention relates to a complex packing, especially adapted for the transport and storage of liquid and pasty products in large quantities, for example of the order of a thousand litres or more, this packing having a large safety factor during handling while full, while enabling a small volume to be obtained when empty. The complex packing is composed firstly of a plastic bag of parallelepiped shape capable of being folded flat when empty, and secondly of a pallet of corresponding parallelepiped shape which constitutes a rigid outer casing for the plastic bag, the pallet comprising a base platform and four dismantlable sides, of which at least two have handles for handling by slings. The platform is furthermore arranged so as to receive a cross-member which may be engaged in the handles of the pallet located immediately below, so as to couple the two pallets together for handling in series.

11 Claims, 11 Drawing Figures

FIG. 1
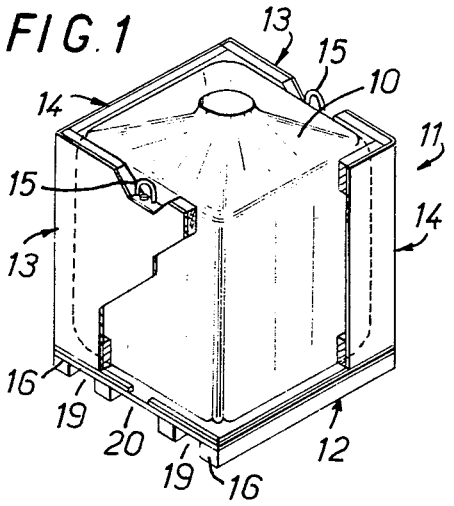
FIG. 2
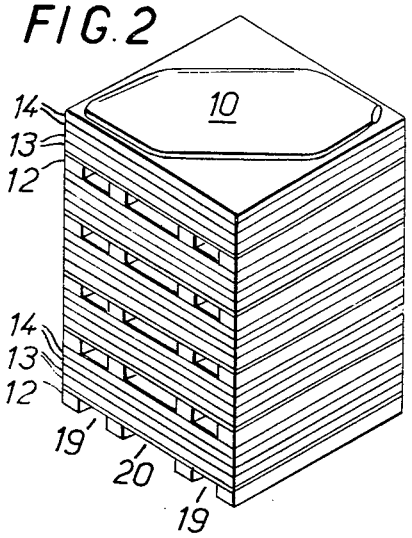
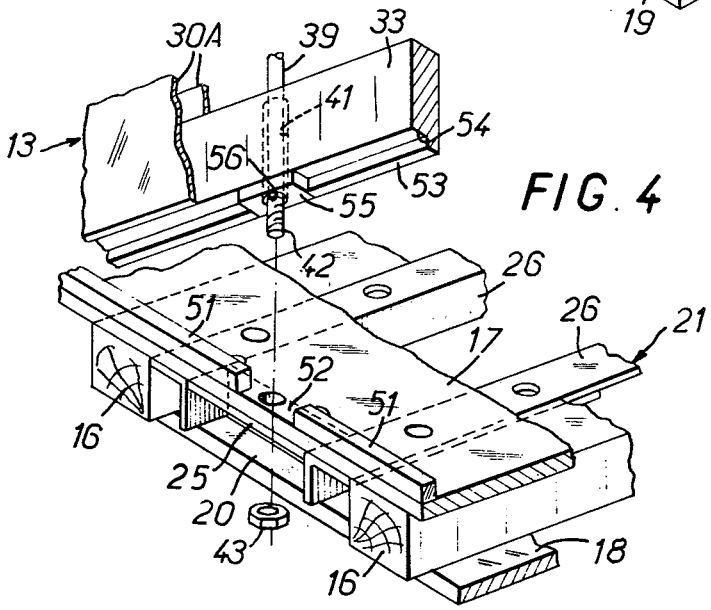
FIG. 4
FIG. 5
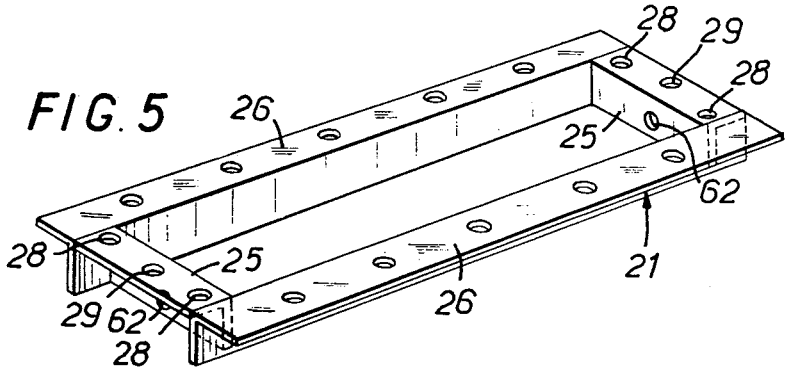

PACKINGS FOR TRANSPORT AND STORAGE ESPECIALLY OF LIQUID AND PASTY PRODUCTS

The present invention relates to a packing device for the transport and storage of products, especially liquid and pasty products.

Packings are generally stiff, and for that reason they take up as much space when empty as when full, which considerably increases the cost of transport.

It has also been proposed to pack products in foldable bags which have the advantage that they take up less space during transport when empty, but they are liable to have insufficient strength during handling while full, particularly if special precautions are not taken.

The present invention has for its object a complex packing intended especially for liquid and pasty products in large quantity, for example, by way of illustration and not in any limitation sense, of the order of one thousand litres or more, this packing having a large safety factor in handling while full, while permitting a small volume to be obtained when empty.

According to the invention, this complex packing is characterized in that it is composed on the one hand of a plastic bag of parallelepiped shape, capable of beig folded flat, and on the other hand of a pallet of corresponding parallelepiped shape so as to constitute a rigid outer casing for the plastic bag, the said pallet having a base platform and four dismantlable sides, of which at least two have handles for handling by slings.

The fact of providing handles of this kind for handling by suspension has the result of creating, during the handling, the introduction of a component of force towards the interior of the pallet, which tends to increase the clamping together of the assembly for maintaining the lateral pressures applied by the bag containing the product, especially in the liquid or pasty state.

There is thus an effect of co-operation between the suspension handles of the pallet, the fact that this pallet is dismantlable and therefore more particularly sensitive to the hydraulic pressures which tend to spread it out, and the fact that it co-acts precisely with a foldable bag containing a product, particularly in the liquid or pasty state, developing hydraulic pressures of this kind.

The fact of providing handling grips on certain sides presents however the problem of good interlocking of the sides with the base platform.

In order to ensure this interlocking, it is preferably provided to arrange in the immediate vicinity of each handle, more particularly level with a notch for the handle, a tie-rod which passes right through the height of the side and through the platform, and receives a fixing means uch as a nut or the like; thus, the handle while introducing a component towards the interior which tends to maintain the hydraulic pressure, makes it possible to transmit a vertical component of the handling forces directly to the lower platform, that is to say in a manner which renders the assembly very strong.

The tie-rod is preferably arranged between the two arms of the handle along such manner as to act in the axis of the handle.

More particularly, the bottom of a notch for the handle receives a mounting plate having three guiding holes, the two outer holes being provided for the two arms of the handle, the central hole to receive the tie-rod.

The handle is preferably mounted slidably between a retracted position on the one hand, inside a notch, so as to permit of stacking when empty in the contour of the platform, and on the other hand, a projecting position above the upper edge of the side for handling. The platform is furthermore arranged so as to receive a cross-member which may be engaged in the handles of a pallet placed immediately below, for the purpose of coupling the two pallets together for handling in series.

One form of embodiment of the invention is described below by way of example, reference being made to the accompanying drawings, in which:

FIG. 1 is a view in perspective with parts broken away of a complex packing according to the invention in a full condition;

FIG. 2 is a view in perspective of several complex packings in the empty state, folded and stacked in a small space.

FIG. 4 is a detail view in perspective and exploded of the assembly of one of the sides of the pallet on the platform;

FIG. 5 shows a perspective view of an armature incorporated in the platform of the pallet;

Figure 3:
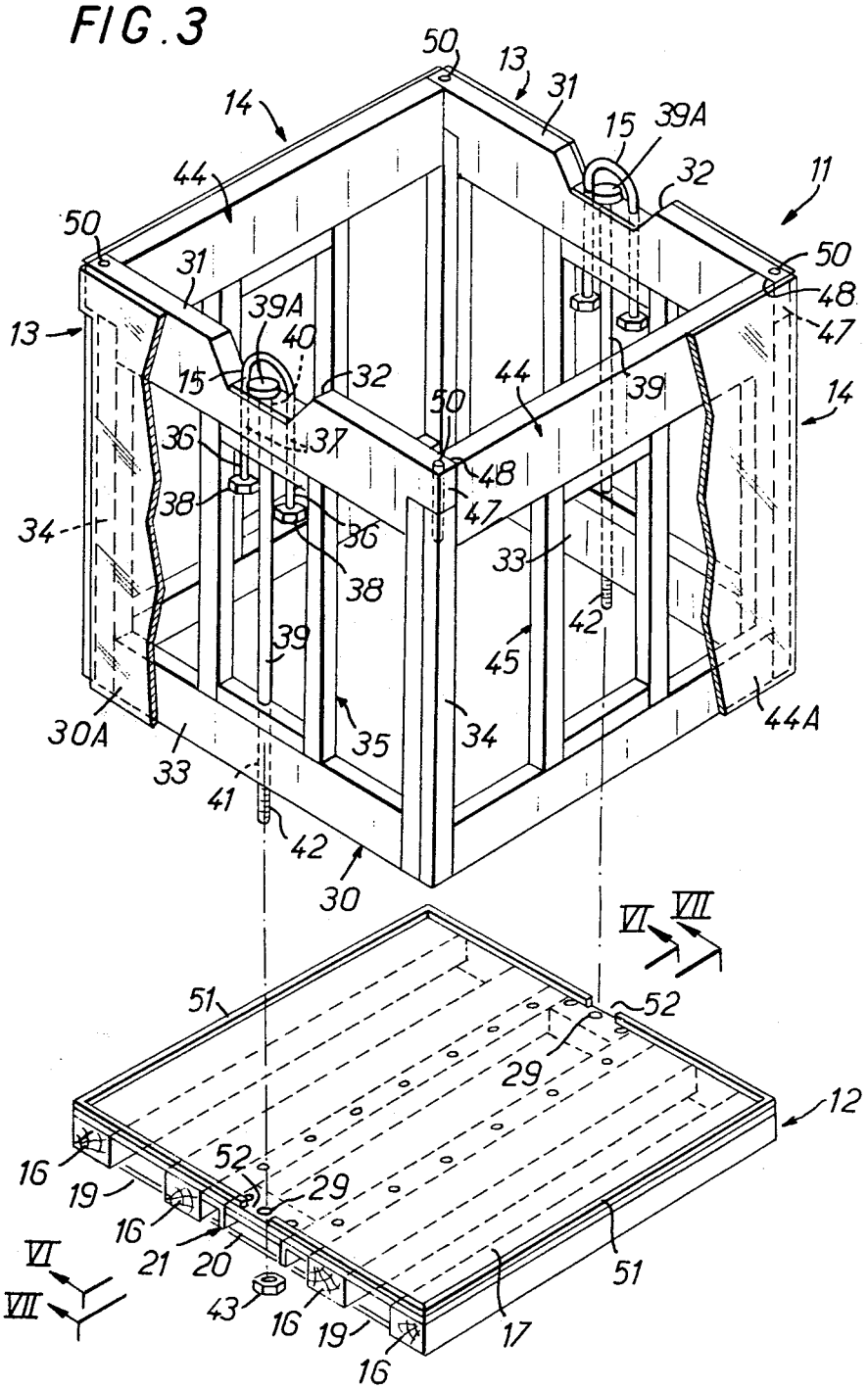
FIG. 3 is an exploded view in perspective, with parts of the pallet broken away.
Figure 6:
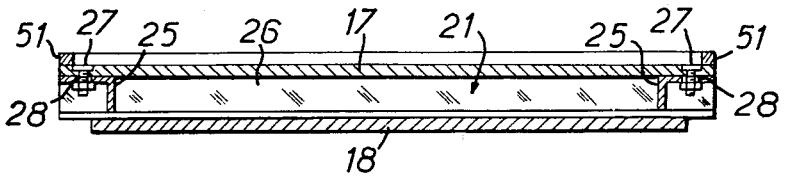
FIGS. 6 and 7 are views of the platform in vertical cross-section, taken along the lines VI—VI and VII—VII of FIG. 3 respectively.
Figure 7:
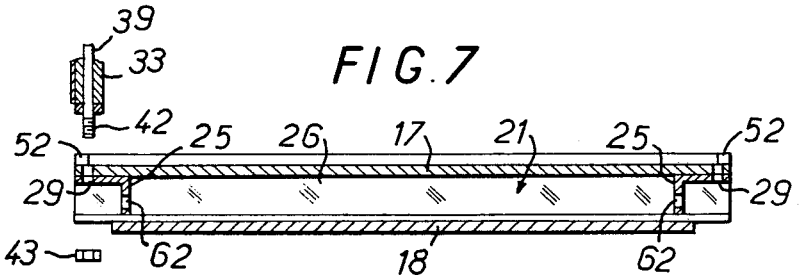
Figure 8:
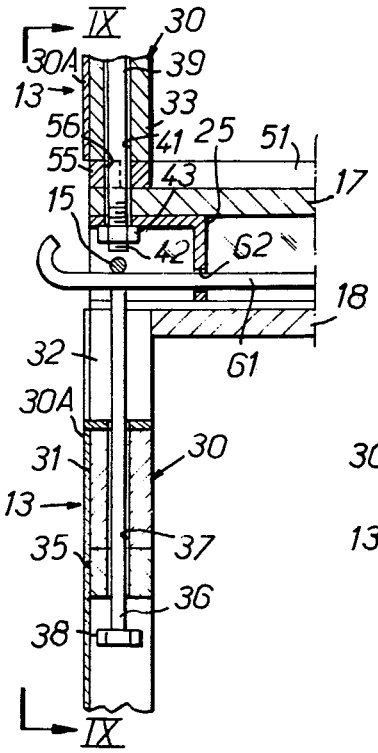
FIG. 8 is a partial view showing how two packings can be coupled together in series, in cross-section taken along the line VIII—VIII of FIG. 9.
Figure 9:
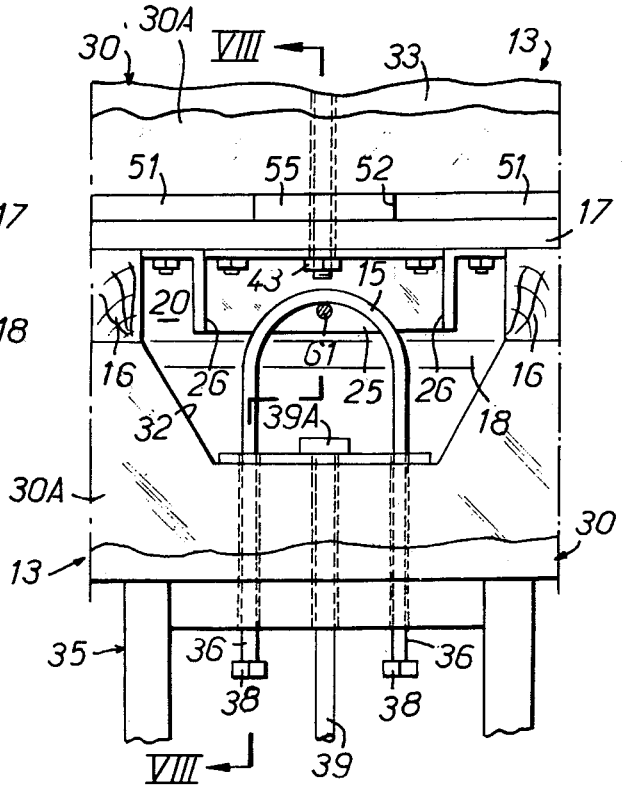
FIG. 9 is a corresponding view in elevation taken along the line IX—IX of FIG. 8.

In the form of construction shown in FIGS. 1 to 11, a complex packing for the transport and storage of products, especially liquid and pasty, is composed of a foldable plastic bag 10 (FIG. 1) having a generally parallelepiped shape, and more particularly with a cubic shape in the example shown. More precisely, this plastic bag 10 has a side of one meter, so as to have a capacity of a thousand liters. It will thus be appreciated that the complex packing is intended to contain especially liquid or pasty products in any quantity, rather large however or even very large.

The complex packing also comprises a pallet 11 also of parallelepiped form corresponding to that of the bag 10, that is to say cubic in the example shown. This pallet 11 forms an outer shell adapted to support the bag 10 at the bottom and along the sides. The pallet 11 is composed (see FIG. 3) of a lower platform 12, two opposite sides 13 provided with handles 15, and two other opposite sides 14 which may not have any handles.

The platform 12 and the sides 13 and 14 are completely dismantlable and are such that each of them does not exceed a square former of pre-determined dimensions, being for example slightly more than one meter on a side. Thus, when the packing is empty, the platform 12 and the sides 13 and 14 can be superimposed, as shown in FIG. 2, and receive the plastic bag 10 folded in turn to a small thickness, so that the volume of the packing when empty and in the folded condition is small. For example, in order to give an idea, an empty unit constituted by the platform 12, the sides 13, 13 and 14, 14 and the folded bag 10, can take up a space of the order of one-fifth of that of the complex packing in the full condition, and it can be seen for example from FIG. 2 that five empty packings superimposed occupy approximately the same space as one packing in the full condition (see FIG. 1).

The platform 12 comprises four beams 16, spaced apart, to which are fixed an upper plate 17 and a lower plate 18. As can be seen from FIG. 3, the periphery of the plate 18 is slightly set back with respect to the periphery of the plate 17 so as to constitute a nesting rebate.

The space 19 formed between each end beam 16 and each central beam 16 is intended to receive the forks of a handling trolley. The space 20 formed between the central beam 16 receives an armature 21 (see FIG. 5) constituted by two angle-irons 25 assembled together by two other angle irons 26. Each angle iron 25 is fixed to the upper plate 17 by screws passing through holes 28 in the angle iron 25. Between the holes 28, the angle-iron 25 has a hole 29, the purpose of which will become apparent later.

Each side 13 comprises a frame 30 and overlapping plates 30A on each side of this frame. The frame 30 comprises an upper beam 31 in which is formed a notch 32 for housing the handle 15, a lower beam 33 and two side beams 34. In the interior of the frame 30 is mounted another smaller frame 35 to increase the rigidity.

The handle 15 which is housed in the notch 32 comprises two arms 36 which are slidably engaged in guiding passages 37 of the upper beam 31 and the frame 35. Each of the arms 36 comprises at its extremity an abutment projection 38.

A vertical rod or tie-rod 39 is slidably engaged in a guiding passage 40 which is formed in the upper beam 31 between the passages 37 and in the guiding passage 41 formed in the beam 33, the passages 40 and 41 being extended in the small frame 35 in order to permit a sliding movement of the rod 39 in the whole of the passages thus aligned.

At its upper portion, the rod 39 comprises an abutment 39A. At its lower extremity, the rod 39 is intended to be engaged in the hole 29 of the angle-iron 25 and this extremity is threaded at 42 in order to receive a fixing nut 43 (see FIG. 7).

The sides 14 are also constituted by a large frame 44 and a small frame 45 and are lined on both sides by the plates 44A.

As can be seen more particularly from FIG. 3, the upper beam 31 of each side 13 comprises laterally two tenons 47, while the upper beam of each frame 44 comprises laterally two mortices 48 in which are engaged the tenons 47. The assembly of the sides 13 and 14 is completed by removable pins 50 which are engaged in the tenons 47 and which penetrate into the uprights of the large frame 41 of the side 14.

The four sides 13, 13 and 14, 14 thus assembled are positioned in the platform 12 (see FIG. 4) while being retained by a rod 51, 51 and on the upper face of the platform 12 at the periphery of this latter. The rod 51 is interrupted at 52 over the passage of the rod 39.

The lower face of all the sides 13, 13 and 14, 14 comprises a rod 53 which is displaced from the periphery by the width of the rod 51 so as to form a rebate 54 fitting on this rod 51. At the level of the space 52 where the rod 51 is interrupted, the lower face of each of the sides 13 receives, instead of the rod 53, a batten 55 which covers the width of the underside of this side 13 in such manner as to be able to fit, in the manner of a projection, in the space 52 and to form a centering means. This batten 55 comprises a hole 56 which is aligned with the hole 41 for the passage of the rod 39.

In order to place the complex packing in a condition ready for service, the sides 13, 13 and 14, 14 are first assembled by engaging the pins 50 and fitting the rebates on the rods 51 of the platform 12, making sure that the battens 55 are well engaged in the spaces 52 for the purpose of ensuring the centering. In this way, the sides 13, 13 and 14, 14 and the platform 12 are perfectly positioned with respect to the others. The threaded extremities 42 of the rod 39 are engaged in the holes 29 of the angle-irons 25, and the nuts 43 are tightened, which strongly fixes the side 13 and in consequence also the sides 13 and in consequence also the sides 14 with the platform 12. It will be noted that the frame constituted by the angle-irons 25, 26 increases the rigidity of the assembly.

The plastic bag 10 is then placed in the pallet thus constituted and it is filled with liquid or pasty product. The product is from tht time on positioned in the complex packing and is ready for transport and storage. It should be noted that the forks of a handling truck can be engaged in the passages 19 of the platform 10. By virtue of the recess formed by the lower plate 18 of the platform 12, this latter can be stacked on a packing placed below, with a nesting effect on the upper edges of the sides of the corresponding pallet. There is thus obtained a locked stack as can be seen from FIG. 11.

It should be noted that each complex packing thus constituted can be advantageously handled by means of slings 69 (see FIG. 10) engaged in the handles 15, and this method of handling has the advantage that the sides 13 tend to be held close to each other in spite of the hydraulic pressure of the liquid or the pasty product contained in the plastic bag 10.

Figure 10:
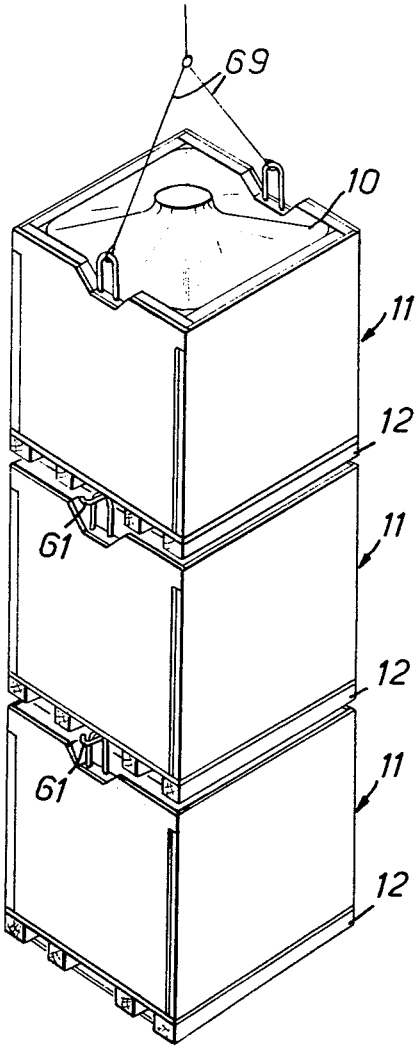
FIG. 10 shows a number of pallets coupled together in series and handled by slings.
Figure 11:
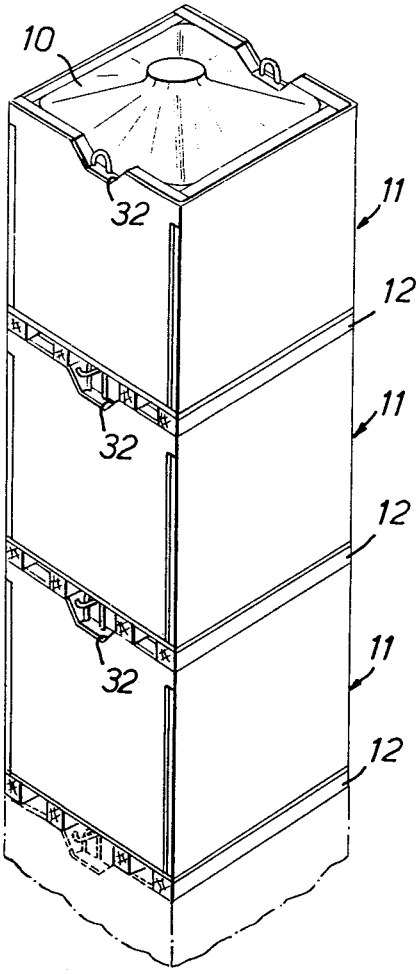
FIG. 11 shows a number of pallets stacked and nested one inside the other.

During the course of handling, a number of complex packings may furthermore be handled in series and, to this end, a transverse bar 61 can be engaged in holes 62 formed facing each other in the angle-irons 25 of the platform 12 of a pallet. This transverse bar 61 is in turn engaged in the handles 15 of the pallet located immediately below, these handles being raised until they abut against the projections 38. In this way, a series of several complex packings can be constituted, as shown in FIG. 10.

It should be noted that in the filled storage position (see FIG. 11) and also in the stacked position when empty (see FIG. 2) the handles 15 are on the contrary withdrawn into the notches 32 of the sides 13.

In this empty position (FIG. 2) it is furthermore possible to cause the rods 39 to move upwards in order that the threaded extremities 42 do not exceed the gauge of the side 13, then bringing the head of the rod 39 closer towards the top of the handle 15, still held down so as not to pass beyond the notch 32. Thus, the sides of the pallet do not exceed the gauge of the empty stack (see FIG. 2) as has previously been stated, which permits a smaller volume to be obtained.

It should be observed that the spindle 61 for the suspension of the pallets in series may be replaced by two spindle ends associated with the angle-irons 25 of the armature 21 and mounted imprisoned and mobile between a working position and a retracted position.

It will also be noted that the pallet 11 may be made of any appropriate material, for example of wood, plywood, sheet metal, light alloy sheet, plastic sheet, etc., while the armature 21 is preferably made of steel.

What I claim is:

1. A composite container comprising a plastic bag of generally parallelepiped shape collapsible into flattened condition and a rigid knock-down type enclosure adapted to accommodate the plastic bag, said enclosure including a pallet-type base member and four side members having lower edges adapted to face the base member and upper edges, an opposed pair of said side members having notches in their upper edges, handle means secured to each of said pair of opposed side members and having a position in which the handle means is located substantially entirely within the effective confines of the corresponding side members, said effective confines being defined in part by the continuation of the upper edge over the notch, releasable assembly means for releasably fastening said pair of opposed side members to said base member, said releasable assembly means having a retracted position in which they are located within said effective confines of their corresponding side members, and releasable securing means for securing said adjacent side members to one another, whereby upon release of said securing means said enclosure can be disassembled and said side members and base members can be stacked in compact form with said releasable assembly means and said handle means in their retracted positions within the effective confines of their respective side members.

2. A composite container according to claim 1, said handle means being slidably secured to their respective side members between the said position which is a retracted position and an extended position in which the handle means extend beyond the effective confines of their respective side members.

3. A composite container according to claim 2, wherein a rebate is provided on the underside of the base member cooperable with the upper edge of a subjacent said enclosure for stacking said enclosures in assembled relation, the base member also having spindle means for hooking the handle means of the subjacent enclosure for lifting said subjacent enclosure therewith.

4. A composite container according to claim 3, said releasable assembly means comprising a rod member extending from said notch to the lower edge of the base member.

5. A composite container according to claim 3, wherein reinforcing means are provided on said base member for receiving said spindle means.

6. A composite container according to claim 4, wherein other reinforcing means are provided on said base member for receiving said rod member.

7. A composite container according to claim 4, wherein said handle means are of inverted U-shaped configuration and said releasable rod is disposed generally between the legs of the inverted U-shaped handle means and generally coplanar therewith.

8. A composite container according to claim 1, wherein said releasable securing means comprises tenons, mortices, and pins passing vertically through said tenons and mortices.

9. A composite container as claimed in claim 1, wherein a rib member is disposed peripherally on the upper side of the base member and adapted to cooperatively engage a rebate disposed on the lower edges of said side members.

10. A composite container according to claim 8, wherein said rib member has gaps therein and the lower edge of the side member is provided with projections extending into said gaps for positioning the side members on the base member.

11. A composite container according to claim 1, wherein said plastic bag and said enclosure are of cubic shape.

* * * * *